343-700 MS AU 254 EX
10/26/82 OR 4,356,492

United States Patent [19]

Kaloi

[11] 4,356,492

[45] Oct. 26, 1982

[54] MULTI-BAND SINGLE-FEED MICROSTRIP ANTENNA SYSTEM

[75] Inventor: Cyril M. Kaloi, Thousand Oaks, Calif.

[73] Assignee: The United States of America as represented by the Secretary of the Navy, Washington, D.C.

[21] Appl. No.: 228,428

[22] Filed: Jan. 26, 1981

[51] Int. Cl.[3] ..... H01Q 1/48

[52] U.S. Cl. ..... 343/700 MS; 343/846

[58] Field of Search ..... 343/846, 700 MS File, 343/854, 829

[56] References Cited

U.S. PATENT DOCUMENTS

| | | | |
|---|---|---|---|
| 3,971,032 | 7/1976 | Munson et al. | 343/700 MS |
| 3,972,050 | 7/1976 | Kaloi | 343/846 |
| 3,978,487 | 8/1976 | Kaloi | 343/829 |
| 3,978,488 | 4/1975 | Kaloi | 343/829 |
| 4,051,478 | 9/1977 | Kaloi | 343/700 MS |
| 4,069,483 | 1/1978 | Kaloi | 343/700 MS |
| 4,072,951 | 2/1978 | Kaloi | 343/700 MS |
| 4,078,237 | 3/1978 | Kaloi | 343/700 MS |
| 4,095,227 | 6/1978 | Kaloi | 343/700 MS |
| 4,117,489 | 9/1978 | Kaloi | 343/700 MS |
| 4,197,544 | 4/1980 | Kaloi | 343/700 MS |

*Primary Examiner*—David K. Moore
*Attorney, Agent, or Firm*—Robert F. Beers; Joseph M. St. Amand

[57] ABSTRACT

A multi-band microstrip antenna comprising a plurality of separate radiating elements which operate at widely separated frequencies from a single common input point. The common input point is fed at all the desired frequencies from a single transmission feed line. A variety of combinations of microstrip elements can be used. The individual radiating elements are each made to look substantially like an open circuit to all other frequencies but the respective frequency at which they are to operate by respective feed point location and dimensioning of the transmission lines from the common input point to the feed points of the separate elements.

2 Claims, 15 Drawing Figures

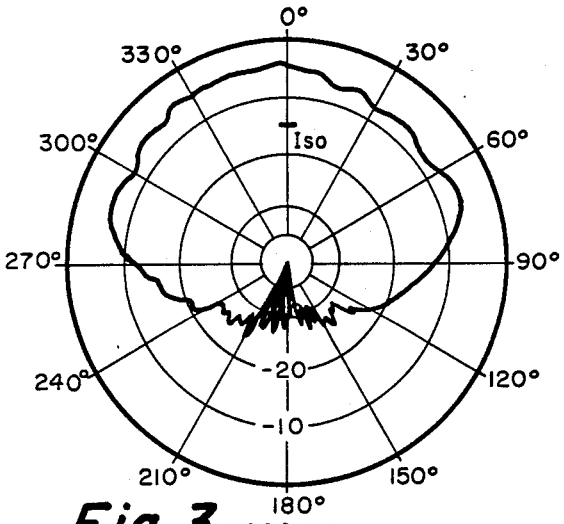
Fig. 3. 5600 MHz
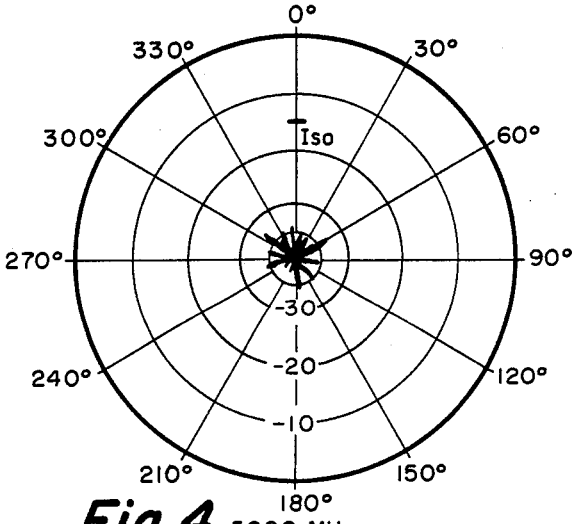
Fig. 4. 5600 MHz
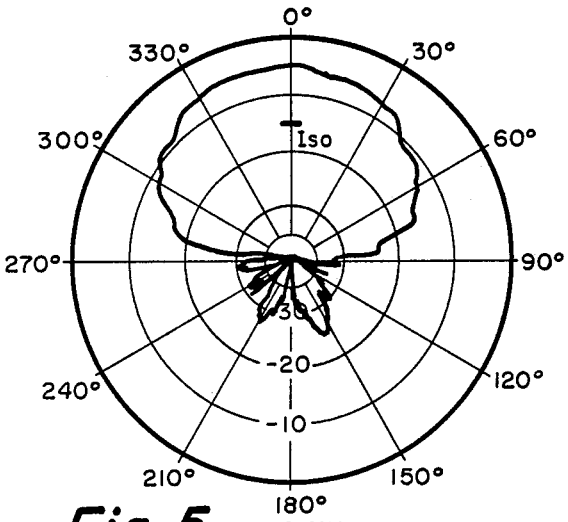
Fig. 5. 5600 MHz
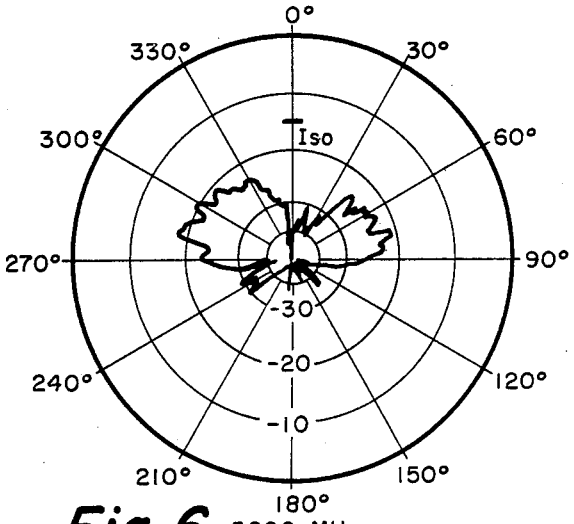
Fig. 6. 5600 MHz
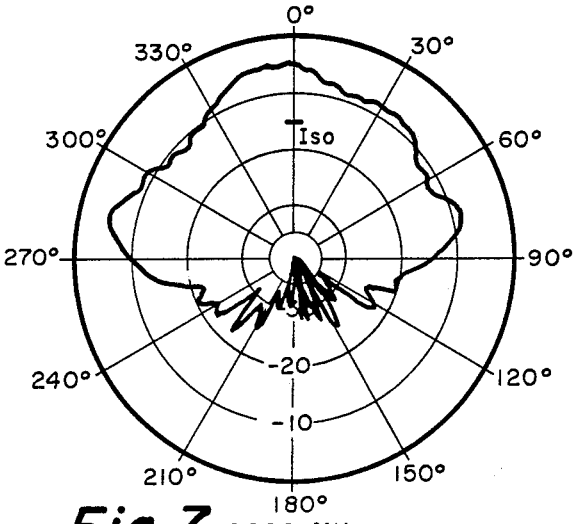
Fig. 7. 9600 MHz
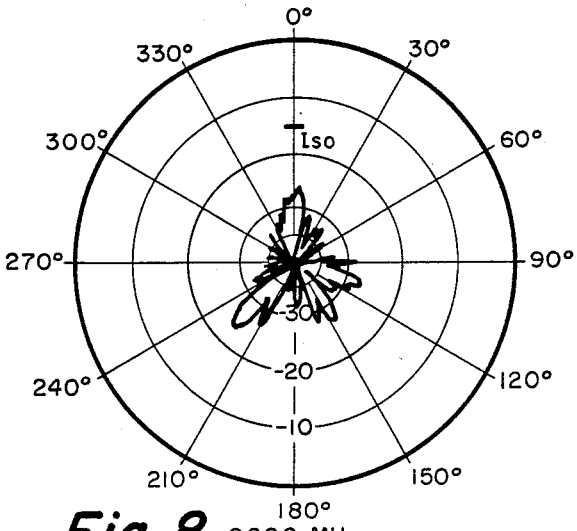
Fig. 8. 9600 MHz

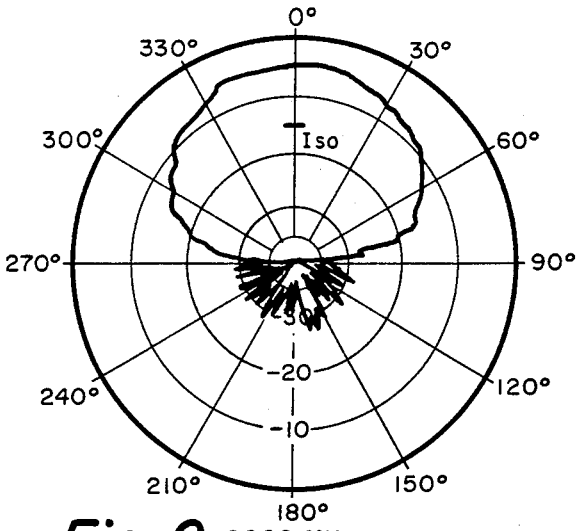
Fig. 9. 9600 MHz
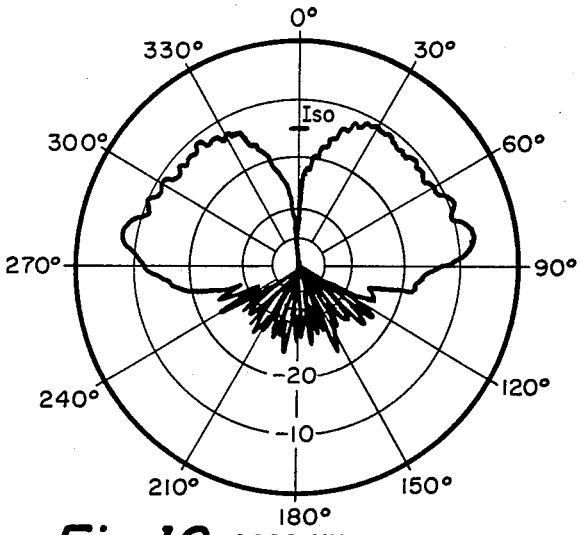
Fig. 10. 9600 MHz
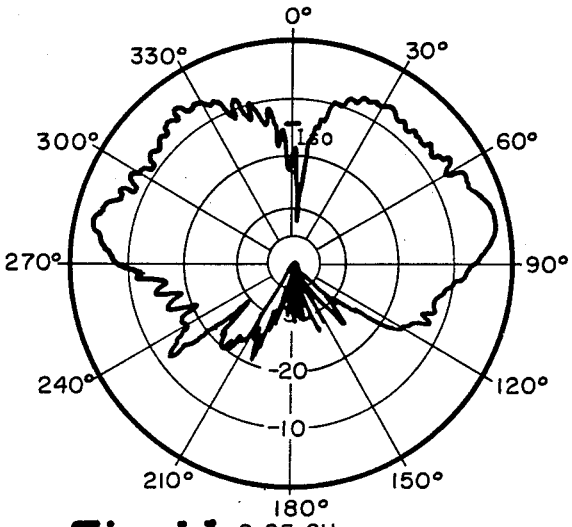
Fig. 11. 9.25 GHz
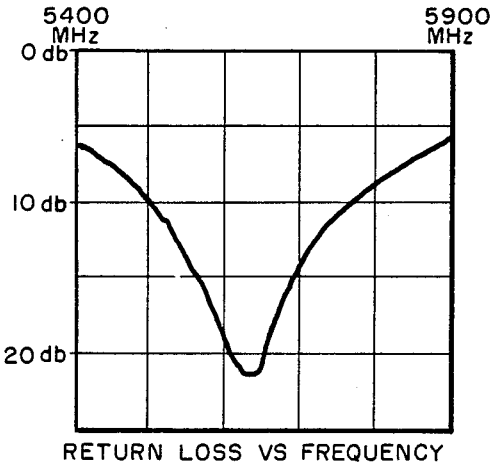
Fig. 12.
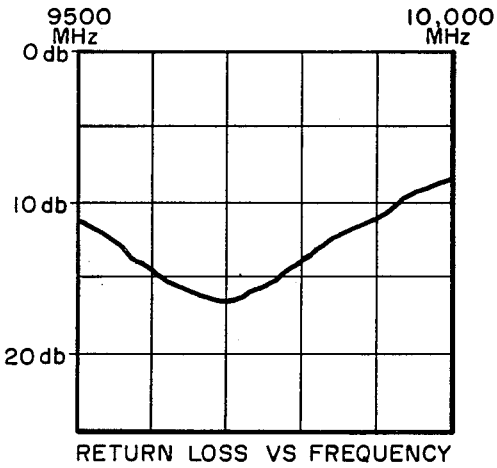
Fig. 13.

MULTI-BAND SINGLE-FEED MICROSTRIP ANTENNA SYSTEM

BACKGROUND OF THE INVENTION

This invention relates to low physical profile antennas and particularly to a multi-band single-feed microstrip antenna system. Various types of microstrip antennas can be used in the present type microstrip system.

For most applications using antennas with very thin substrates, it is extremely difficult to produce antennas that are wide band enough to cover two or more widely spaced frequencies. Normally, a plurality of antennas with a plurality of input connectors are required. It is logistically desirable to have an antenna system to be used at two or more different widely spaced frequencies (e.g., for two or more purposes) using only one input connector.

SUMMARY OF THE INVENTION

The present antenna system is intended to allow one microstrip antenna system fed from a single common input point to operate simultaneously at two (or more) different widely separated frequencies.

The multi-band microstrip antenna comprises two (or more) separate microstrip radiating elements which operate at different widely separated frequencies while fed from a single common input point. The common input point is fed at both (two or more) frequencies from a single transmission feed line, and the different elements are connected at their respective feed points to the common input point by respective transmission lines. The individual transmission lines dimensions are varied to minimize or substantially eliminate any effect that one radiating element might have on the other radiating elements.

The several antenna elements and the feed lines can be photo-etched simultaneously. Each dielectric microstrip element consists essentially of a conducting strip called the radiating element and a conducting ground plane separated by a dielectric substrate. The length of each radiating element is approximately one-half wavelength of the respective frequency for electric type microstrip elements, and approximately one-quarter wavelength for magnetic type microstrip elements. The width may be varied depending upon the desired electrical characteristics for the elements. The conducting ground plane is usually much greater in length and width than the area of the radiating elements.

The thickness of the dielectric substrate should be much less than one-fourth the wavelength.

The antenna system hereinafter described can be used in missiles, aircraft and other type applications where a low physical profile antenna is desired. This structure provides an antenna with ruggedness, simplicity, low cost, a low physical profile, and conformal arraying capability about the body of a missile or vehicles where irregular surfaces are used, while giving excellent radiation coverage. The antenna can be mounted over an exterior surface without protruding, and be thin enough not to affect the airfoil or body design of the vehicle. The thickness can be held to an extreme minimum depending upon the bandwidth requirements. Due to its conformability, this antenna assembly can be applied readily as a wrap around band to a missile body without interfering with the aerodynamic design of the missile.

The antenna can be fed very easily from the ground plane side.

BRIEF DESCRIPTION OF THE DRAWINGS

FIG. 3 shows a typical E-plane radiation pattern for a dual antenna as in FIG. 1*a* at the lower frequency.

FIG. 4 shows the cross-polarization plot for the radiation pattern as in FIG. 3.

FIG. 5 shows a typical H-plane radiation pattern for a dual antenna as in FIG. 1*a* at the lower frequency.

FIG. 6 shows the cross polarization plot for the radiation pattern as in FIG. 5.

FIG. 7 shows a typical E-plane radiation pattern for a dual antenna as in FIG. 1*a* at the higher frequency.

FIG. 8 shows the cross polarization plot for the radiation pattern antenna as in FIG. 7.

FIG. 9 shows a typical H-plane radiation pattern for a dual antenna as in FIG. 1*a* at the higher frequency.

FIG. 10 shows the cross polarization plot for the radiation pattern as in FIG. 9.

FIG. 11 shows an E-plane radiation pattern characteristic of higher order mode excitation.

FIG. 12 shows a plot of the return loss vs. frequency for a dual antenna as in FIG. 1*a* at lower frequency.

FIG. 13 shows a plot of return loss vs. frequency for a dual antenna as in FIG. 1*a* at higher frequency.

DESCRIPTION OF THE PREFERRED EMBODIMENT

Figure 1A:
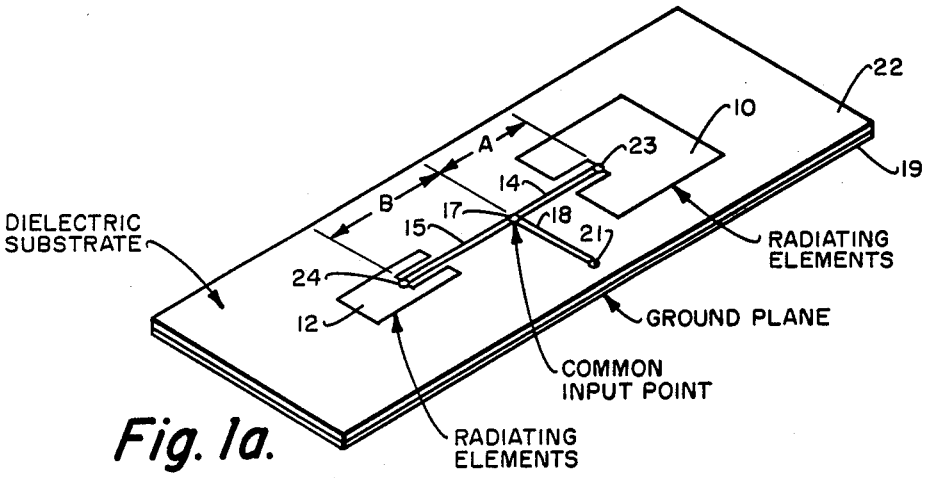
FIG. 1*a* is a perspective view of a preferred embodiment of the invention showing a multi-band single-feed dual microstrip antenna system.
Figure 1B:
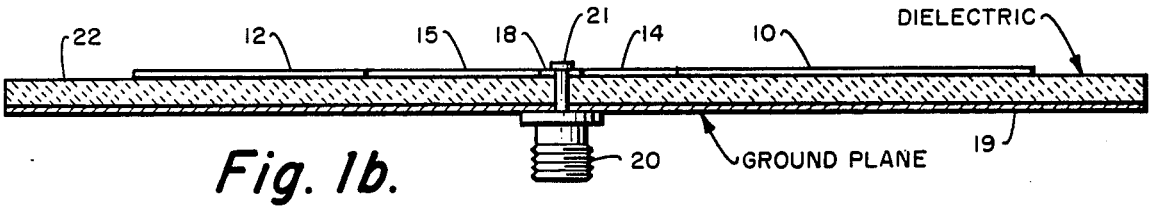
FIG. 1*b* is an elevational view of the antenna system shown in FIG. 1*a*.

A preferred embodiment of the multi-band single-feed dual microstrip antenna system comprises two separate microstrip radiating elements 10 and 12 fed by microstrip transmission lines 14 and 15, respectively, from a single common input point 17, as shown in FIGS. 1*a* and 1*b* of the drawings. The common input point 17 is fed at two different frequencies from a single microstrip transmission line 18 connected at the common input point 17, as shown, with a coaxial-to-microstrip adapter 20 at end 21 of the transmission line 18. The common input point 17 can be fed directly from a coaxial-to-microstrip adapter, if desired. The microstrip radiating elements 10 and 12 are coplanar and are separated from a ground plane 19 by a dielectric substrate 22.

Figure 2A:
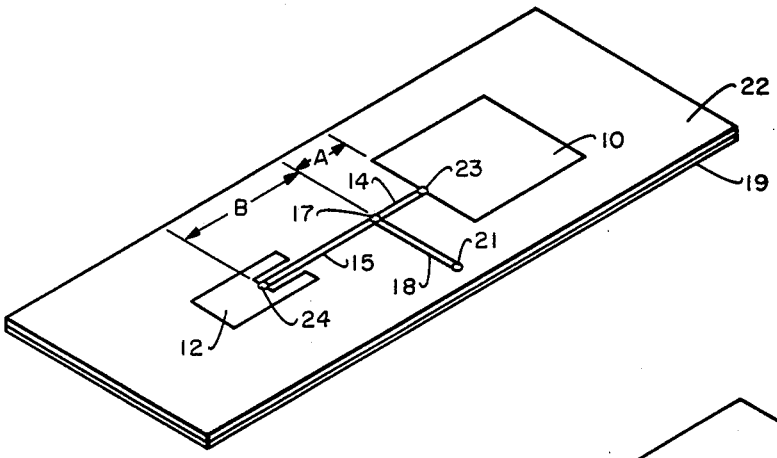
FIG. 2*a* shows a different combination of microstrip radiating elements for the antenna system of FIG. 1*a*.

Radiating elements 10 and 12 can both be notch fed, as shown; or any of end fed, offset fed, coupled fed, corner fed, etc., such as disclosed in U.S. Pat. Nos. 3,972,050; 3,978,487; 3,978,488; 4,051,478; 4,069,483; 4,072,951; 4,078,237; 4,095,227; 4,117,489; and 4,197,544 for various microstrip antennas, or a combination of two different types of radiating elements, as shown in FIG. 2*a*, for example, can be used. If desired, it is possible for more than two radiating elements to be used, such as the three element system shown in FIG. 2*b*, all at different frequencies provided that the same type techniques discussed below for a two element system are used to minimize the effects each radiating element may have on the other radiating elements.

The lengths A and B and the width of the transmission lines 14 and 15, respectively, from the common input point 17 to respective feed points 23 and 24 of the individual radiating elements 10 and 12, determines the interdependence between each of the radiating elements of the multiband antenna system. The width of a transmission line is selected depending upon the required impedance for the transmission line; once the width is determined the length of the transmission line can be varied to perform the required impedance transformation. For example, the effect that one radiating element could have on the other radiating element can be minimized by choosing proper lengths A and B and a width for transmission lines 14 and 15, respectively.

At the operating frequency of the larger radiating element 10, for example, the input impedance looking toward the smaller element 12 from common input point 17 should approach an open circuit, i.e., a very high impedance. The input impedance to the smaller radiating element 12 can be adjusted to a certain degree for accomplishing this by adjusting the transmission line length and width between the common input point 17 and feedpoint 24 to the smaller radiating element, i.e., varying the length and width of transmission line 15. In essence, this isolates the smaller microstrip radiating element 12 from the common input point 17. While total isolation is almost impossible, sufficient isolation can be obtained in this manner so that one element will operate independently of the other. The converse is also true.

Theoretically complete isolation probably is desired; however, to enhance bandwidth and to facilitate impedance matching there can be some slight interaction between the two radiating elements 10 and 12, since complete isolation usually is difficult. Additionally, test results have shown that, for the most part, slight interactions do not really change the radiation patterns significantly and there are even lesser effects on other electrical characteristics of the radiating elements.

In this antenna system one radiating element is matched while the other radiating element is electrically decoupled through a transformation circuit (i.e, transmission line) in order that both radiating elements can be fed simultaneously from a common input point with a single feed line. The larger radiating element 10 operates at the lower frequencies and the smaller radiating element operates at the higher frequencies.

The smaller radiating element 12 almost always looks like an open circuit to the lower frequencies and therefore the matching problem to isolate the smaller radiating element is not difficult. Usually it is easier to obtain isolation between two radiating elements when the frequencies are not harmonics or subharmonics of one another. However, one does not always have the option of selecting the frequency, and in such cases the higher frequency selected for the smaller radiating element 12 may cause the larger radiating element 12 to be excited in a higher-order mode of excitation. When this occurs, there is a two-fold problem, i.e., the feed point 23 to the larger radiating element must be located so as not to excite the larger radiating element at the higher frequency and at the same time a feed point location must be selected for the larger radiating element 10 such that it will match the common input point at the lower frequency.

There are two ways for doing this. The first is to make the input impedance into element 10 a low impedance by the positioning of the feed point and use a transmission line to transform the impedance at the common input point into an open circuit (i.e., high impedance). The second is to make the input impedance into the element 10 a high impedance and place the feed point of the element at the common input point. Where it is difficult to physically locate the element feed point at the common input point a transformation transmission line can be used to maintain the high impedance (open circuit) level. Teachings as to how one can obtain different impedance levels are shown in the aforementioned U.S. Patents.

If it is desired to resonate only the lower frequency radiating element, the input to the higher frequency radiating element when transformed to the common point must look like a high impedance to the lower frequency; the converse is also true. Transformation (matching) may also be provided by varying both the width and the length of the transmission line between common input point 17 and the feed point on the radiating element. Another way to impedance match at two or more operating frequencies is to permit some small amount of high-order mode of excitation to allow ease in matching at the lower frequencies without greatly affecting the radiation patterns.

Figure 2B:
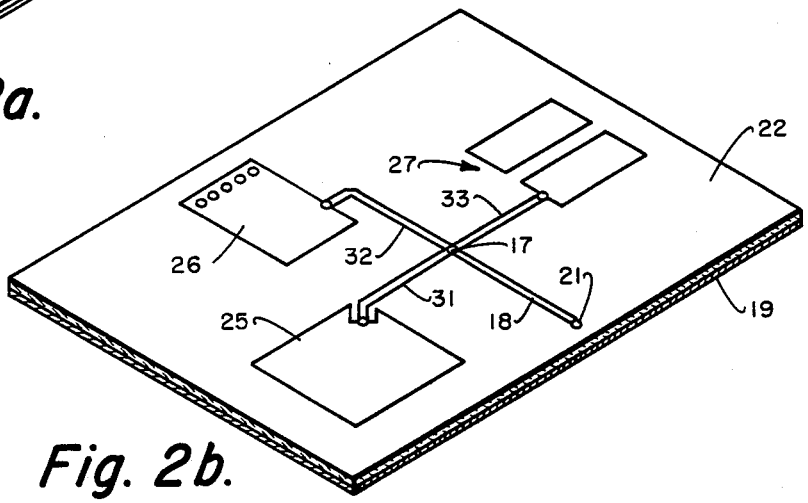
FIG. 2*b* shows an antenna system of the present invention using more than two radiating elements.

While two notch different size fed microstrip elements are shown in FIG. 1*a*, in FIG. 2*a* an end fed microstrip element is substituted for radiating element 10 with feed point 22 located at the edge of element 10. This figure merely illustrates how two types of microstrip antennas can be used together in the multi-band single-feed dual microstrip antenna system of the invention; a large variety of combinations can be used to provide various radiation patterns desired. The techniques discussed above are also applicable to antenna systems using more than two radiating elements. As shown in FIG. 2*b*, three different types and sizes of radiating elements that operate on widely separated frequencies, are used. The combination in FIG. 2*b* comprises a notched corner fed electric microstrip radiating element 25, an offset fed magnetic microstrip radiating element 26 (which is shorted to the ground plane), and a coupled fed electric microstrip radiating element 27 each connected to and fed from common input point 17, via respective transmission lines 31, 32 and 33. Various combinations of microstrip radiating elements can be used, to provide desired radiation patterns.

FIGS. 3, 4, 5 and 6 show radiation plots for a typical dual antenna element as shown in FIG. 1*a* at the lower frequency. FIGS. 3 and 5 are E-plane and H-plane plots, respectively, and FIGS. 4 and 6 are their respective cross polarization plots. These plots show patterns very similar to single element/single mode patterns and no degradation in the gain characteristics.

FIGS. 7, 8, 9 and 10 show radiation plots for the dual antenna element in FIG. 1*a*, but at the higher frequency. FIGS. 7 and 9 are E-plane and H-plane plots, respectively, and FIGS. 8 and 10 are their respective cross polarization plots. Note that the cross polarization component, shown in FIG. 10, is much higher at the higher frequency band than at the lower frequency band, shown in FIG. 6. As mentioned previously, this is due to a slight excitation of the higher order modes induced in the larger element when operating at the higher frequency. As one can observe from FIG. 6, that although the larger element is somewhat excited at the higher frequency, the predominate excitation occurs in the smaller element at the higher frequencies. Since the patterns are only slightly distorted, much use can be derived from the design configuration in FIG. 1*a*.

As an example of an intolerable design, FIG. 11 shows an E-plane plot of a dual element where predominantly the larger radiating element is excited at both the lower and the higher frequencies. Here are noted patterns characteristic of excessive higher order mode excitation.

FIGS. 12 and 13 show plots of return loss vs. frequency for the dual antenna element shown in FIG. 1*a;* FIG. 12 at the lower frequency and FIG. 13 at the higher frequency. The bandwidth as compared to a single element first order mode is only slightly degraded.

Obviously many modifications and variation of the present invention are possible in light of the above teachings. It is therefore to be understood that within the scope of the appended claims the invention may be practiced otherwise than as specifically described.

What is claimed is:

1. A multi-band single-feed microstrip antenna system, comprising:

a. a thin ground plane conductor;

b. a plurality of separate thin radiating elements spaced from and electrically separated from said ground plane conductor by a dielectric substrate, one said radiating element for each frequency to be radiated; said respective radiating elements being operable to radiate simultaneously at a different and widely separated frequency from each other, the length dimension of each said respective radiating elements being different and determined by the respective radiation frequency wavelength of each radiating element;

c. each of said radiating elements having a respective feed point thereon;

d. a single common input point;

e. said common input point being fed at all the different respective operating frequencies of said radiating elements;

f. each of said radiating elements having its respective feed connected to said common input point by means of a respective single microstrip transmission line; each one of said radiating elements being matched at its respective operating frequency to the common input point while simultaneously being electrically decoupled from each of the other of said radiating elements through its respective one of said single transmission lines which act as transformation circuits, thus permitting all said radiating elements to be fed simultaneously from said common input point through said respective single transmission lines, the lengths and widths of each of the respective single transmission lines determining the interdependence between each of said respective radiating elements;

g. each respective single microstrip transmission line which connects said common input point with the feed point on its respective one of said radiating elements being dimensioned to minimize the effect that any one of said radiating elements can have on the other of said radiating elements; the dimensions of said respective single transmission lines being varied such that at the operating frequency of each one of said respective radiating elements the input impedance looking toward the other of said radiating elements from said common input point approaches an open circuit, substantially isolating the respective radiating elements from each other while simultaneously being fed at said different respective frequencies from said common input point;

h. any of the length and width dimensions of each of said single transmission lines and the location of the feed point on each of the respective radiating elements being variable to minimize the effects of any one of said radiating elements on any of the other said radiating elements and thus operate to effectively isolate each of said radiating elements from the other of said radiating elements.

2. A multi-band single-feed microstrip antenna system as in claim 1 wherein said radiating elements comprise a combination of various types of both electric and magnetic microstrip radiating elements.

* * * * *